US008127960B2

(12) United States Patent
Li

(10) Patent No.: US 8,127,960 B2
(45) Date of Patent: Mar. 6, 2012

(54) HOLDING DEVICE FOR SECURING THE TOP MOUNTING SECTION OF A CONTAINER

(75) Inventor: Feng-Jiun Li, Tainan (TW)

(73) Assignee: Hightlight Tech Corp., Tainan (TW)

( * ) Notice: Subject to any disclaimer, the term of this patent is extended or adjusted under 35 U.S.C. 154(b) by 1429 days.

(21) Appl. No.: 11/672,046

(22) Filed: Feb. 7, 2007

(65) Prior Publication Data

US 2008/0185804 A1 Aug. 7, 2008

(51) Int. Cl.
*B65D 43/26* (2006.01)
*B65D 43/16* (2006.01)

(52) U.S. Cl. ..... 220/263; 220/908.3; 220/826; 220/259.2; 220/523; 220/502; 232/47

(58) Field of Classification Search ..... 220/501, 220/502, 523, 262, 263, 825; 232/43.1, 43.2, 232/43.4, 43.5, 44, 47, 48, 51
See application file for complete search history.

(56) References Cited

U.S. PATENT DOCUMENTS 2,612,896 A * 10/1952 Fox ..... 131/235.1
2,645,229 A * 7/1953 Stillman ..... 131/235.1

* cited by examiner

*Primary Examiner* — Anthony Stashick
*Assistant Examiner* — James N Smalley
(74) *Attorney, Agent, or Firm* — Leong C. Lei

(57) ABSTRACT

A holding device for securing the top mounting section of a container is disclosed. The holding device the top mounting section of the container including a received section, the top mounting section in engagement with the receiving section, characterized in that the receiving section is pivotally sealed at the lower edge of the top mounting section and the circumferential edge of the top mounting section is a pivot point connecting with the receiving section, the receiving section has a funnel shape extended downward and the extension is a guiding hole.

15 Claims, 7 Drawing Sheets

HOLDING DEVICE FOR SECURING THE TOP MOUNTING SECTION OF A CONTAINER

BACKGROUND OF THE INVENTION (a) Technical Field of the Invention

The present invention relates to a holding device, and in particular, a holding device for securing the top mounting section of a container to stop leakage of odor from the container.

(b) Description of the Prior Art

Liquid waste have been generated in food industries and in other industries. Large containers are used to contain the liquid waste to prevent leakage as well as the dissipation of bad smell from the container. However, it has not been found any container which could prevent the dissipation of bad smell and the leakage of the liquid waste.

FIGS. 1 to 3 show conventional holding device for container. As shown in FIG. 1, the container 1 contains polluted used water A and a top cover 11 is used to cover the container 1 to prevent the leakage of polluted water A. However, the top cover 11 could not isolate the smell produced by the polluted water A.

As shown in FIG. 2, the oil container 2 contains waste oil B and a funnel C is required for the tank 2. When the tank 2 is fully filled, the heavy oil tank 2 is a burden to the user.

Referring to FIG. 3, the garbage tank 3 has a moveable top cover 31 and a linking shaft to uplift the top cover 3. When the top cover 31 is lifted, liquid waste is dumped into the garbage tank 3, after that, the top cover 31 lightly touches the top edge of the garbage tank 3. However the top cover 31 could not prevent odor from dissipating from the garbage tank 3. When the liquid waste is to be removed from the garbage tank 3, the top cover 31 cannot be removed from the garbage tank 3 and therefore, the top cover 31 interferes the operation in discarding garbage.

Accordingly, it is an object of the present invention to provide a holding device for securing the top mounting section of a container which mitigates the above drawbacks.

SUMMARY OF THE INVENTION

The primary purpose of the present invention is to provide a holding device for container for securing comprising the top mounting section of the container including a receiving section, the top mounting section in engagement with the receiving section, characterized in that the receiving section is pivotally sealed at the lower edge of the top mounting section and the circumferential edge of the top mounting section is a pivot point connecting with the receiving section, the receiving section has a funnel shape extended downward and the extension is a guiding hole.

Yet a further object of the present invention is to provide a seat having an external edge mounted with a vertical seat extended upward, a top mounting section which is pivotally mounted to the top end of the vertical shaft, a receiving section pivotally sealed at the lower edge of the top mounting section, wherein the circumferential edge of the top mounting section is provided with a pivot point for connection with the receiving section, and the shape of the receiving section is a downward funnel shape, and a guiding hole is provided at the extension.

Still a further object of the present invention is to provide a holding device for securing the top mounting section of a container, wherein the receiving section is further mounted with a support for pivotally mounted with the covering plate, and the covering plate urging the other side of the guiding hole facing the support is mounted with a heavy block, and a pull-to-connect element is disposed between the top mounting section and the covering plate, the pull-to-connect element has a first pull-to-connect member pivotally mounted with the top mounting section, and the first pull-to-connect member is pivotally mounted to a second pull-to-connect member pivotally connected with the top mounting section.

A further object of the present invention is provide a holding device for securing the top mounting section of a container, wherein the seat has a cavity having an opening towards for holding the present element, one end of the pressing element is extended out of the cavity and the cavity is provided with a cavity connection section for pivotal connection with the pressing element, and the other end of the pressing element is pivotally mounted with a reciprocating member.

Still a further object of the present invention is to provide a holding device for securing the top mounting section of a container, wherein the seat is pivotally mounted with a pressing element is pivotally mounted with a reciprocating element being upwardly connected to the vertical shaft and the pivot point of the top mounting section.

The foregoing object and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
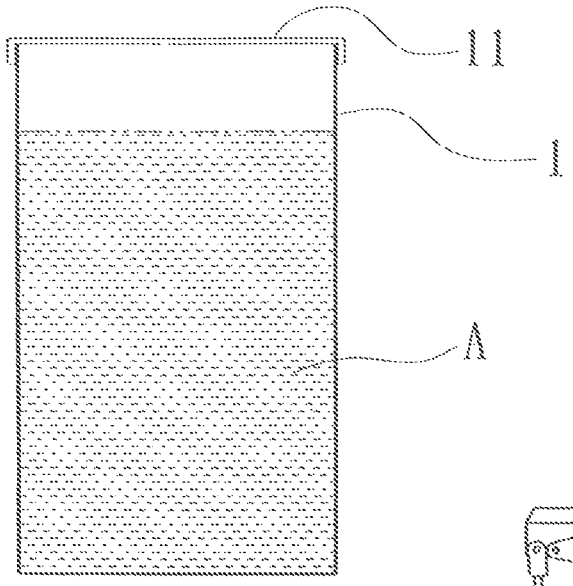
PRIOR ART FIG. 1
FIGS. 1 to 3 show convention holding device for container.
Figure 2:
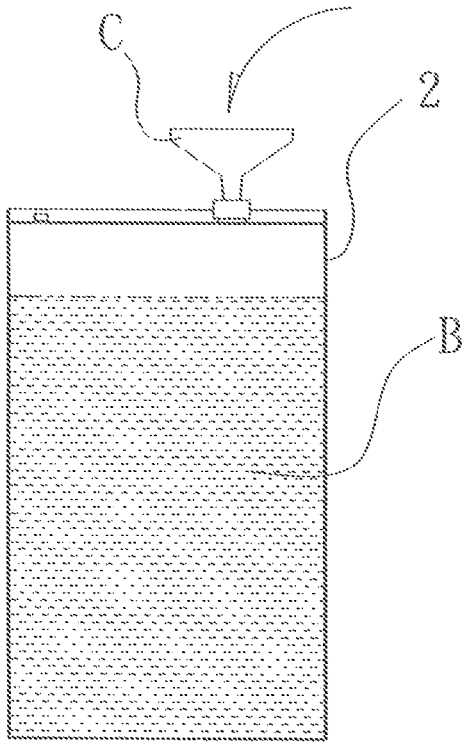
PRIOR ART FIG. 2
Figure 3:
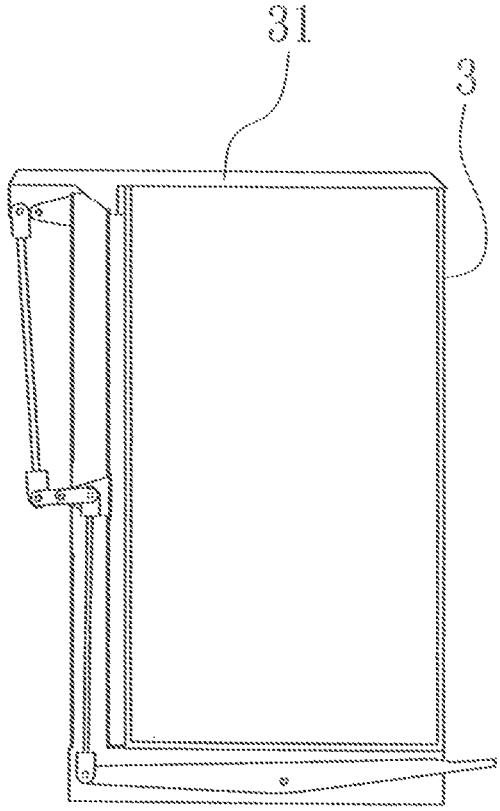
PRIOR ART FIG. 3
Figure 4:
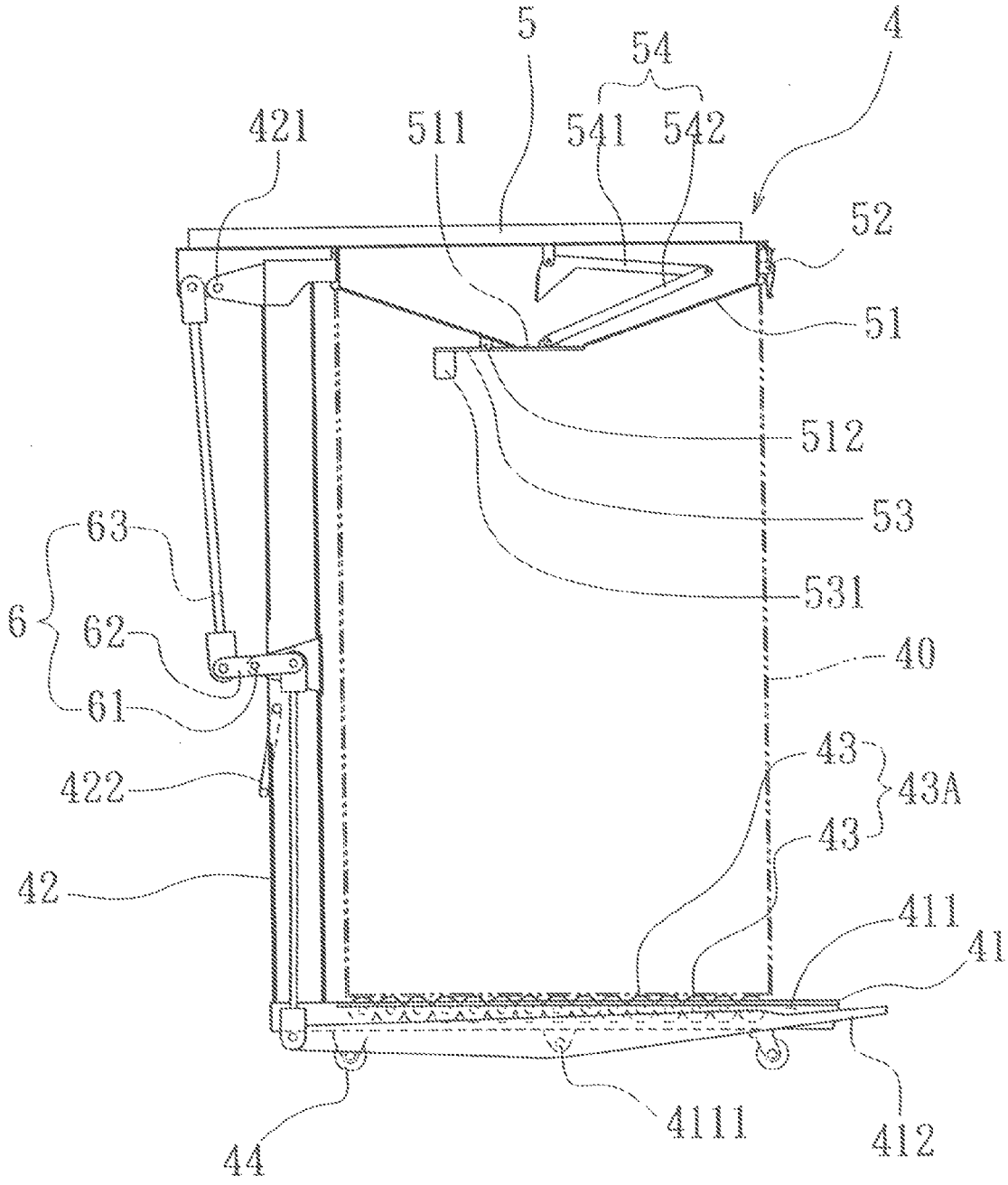
FIG. 4 is a perspective view of a holding device of the present invention.
Figure 5:
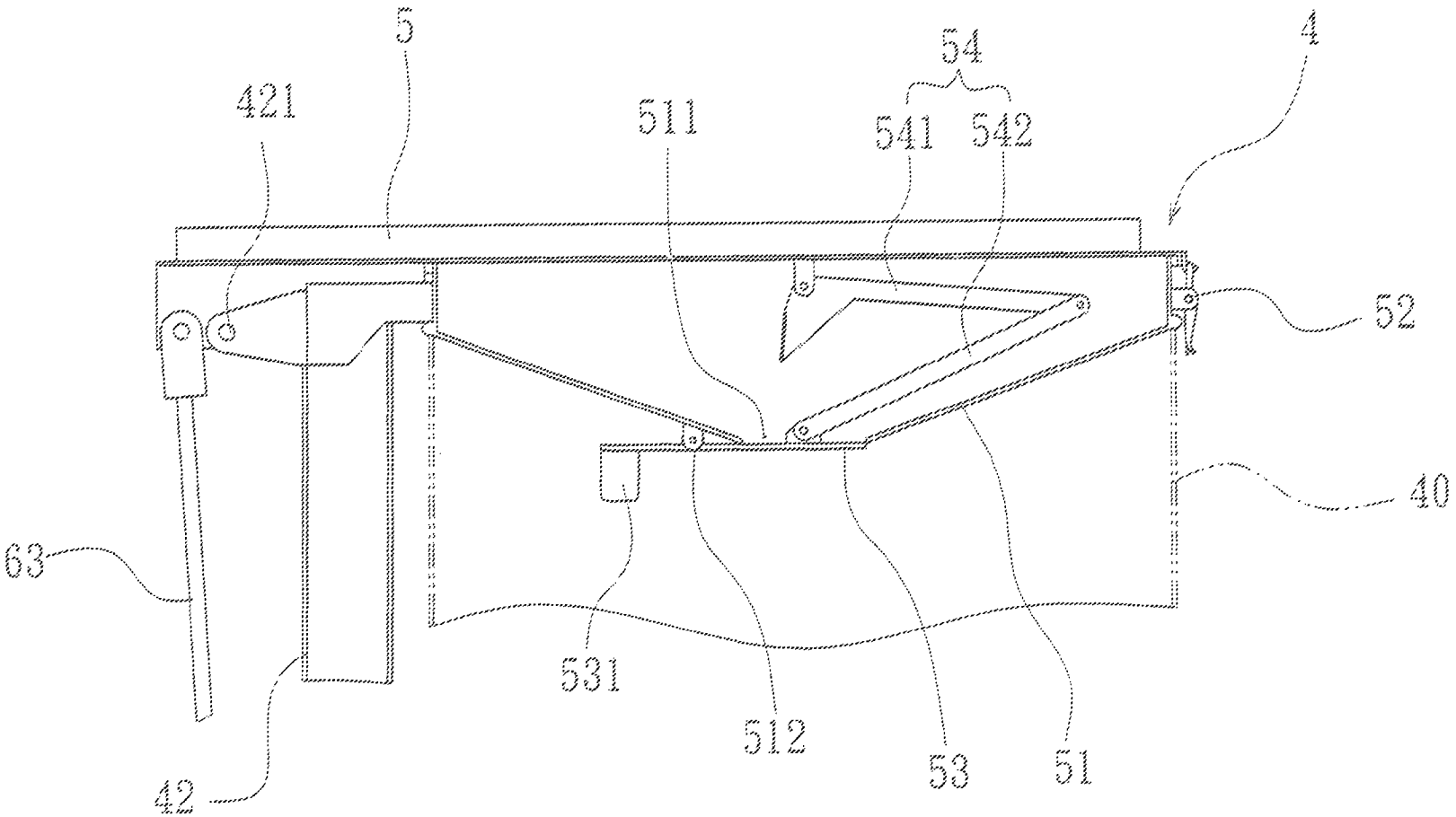
FIG. 5 is a partial schematic view of the holding device of the present invention.
Figure 6:
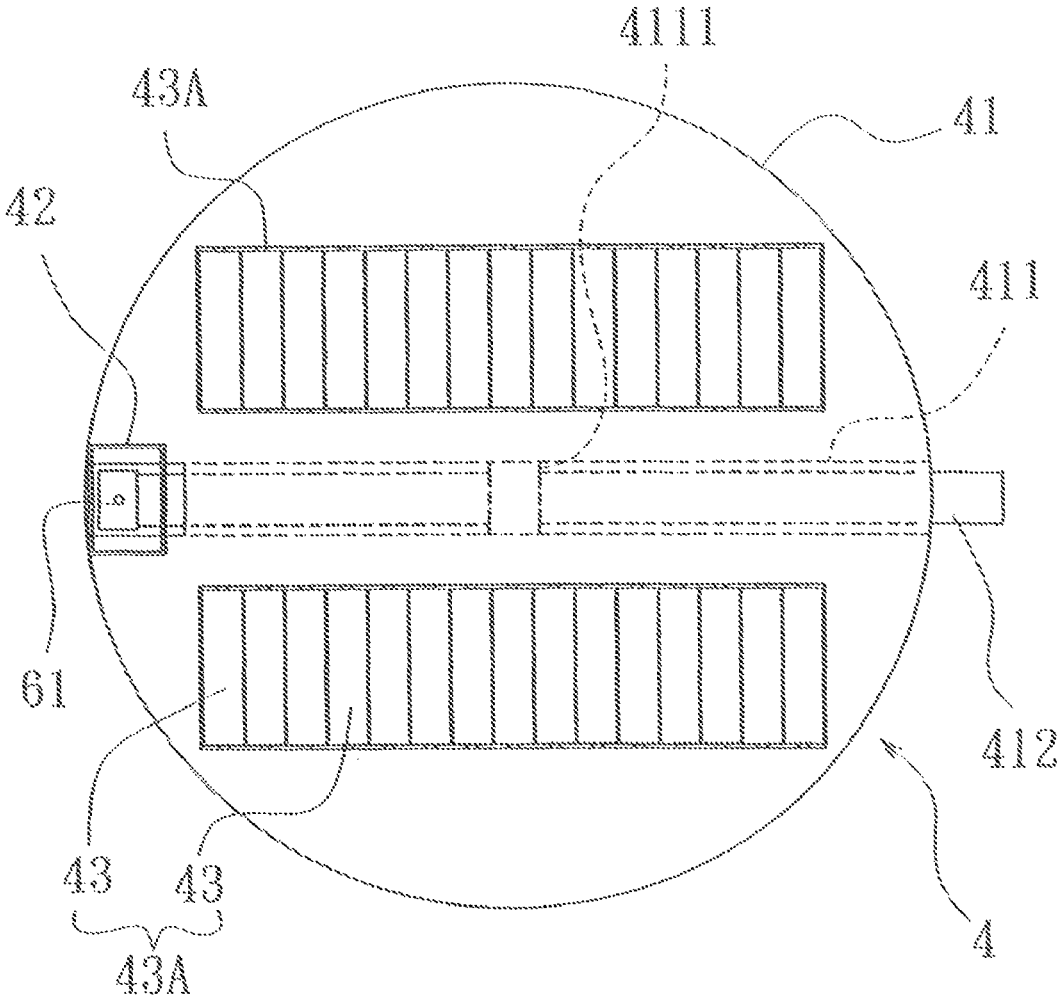
FIG. 6 is the bottom view of the seat of the holding device of the present invention.
Figure 7:
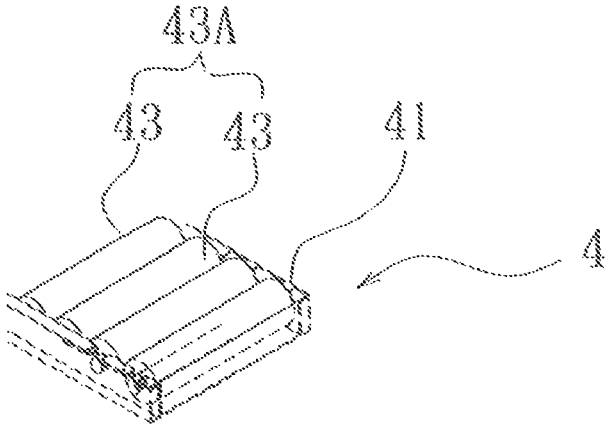
FIG. 7 is a schematic perspective view of the roller module of the present invention.

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Referring to FIGS. 4 to 7, there are shown a holding device for container or the like. The holding device includes a seat 4 for holding container 40. The seat 4 comprises a seat section 41, a top mounting section 5, and a reciprocating member 6. The seat section 41 has a cavity 411 with a downward facing opening. The cavity 411 contains a pressing element 412. The external side of the seat section 41 is a vertical shaft 42 extended upward. One end of the pressing element 412 is extended out the front side of the cavity 411 and the cavity 411 is a cavity connection section 411 pivotally connected with the pressing element 412. In the other end of the pressing element 412 is extended to the rear side of the seat section 41. The two sides of the cavity 411 are wheels 43 protruded from the top section of the seat section and the wheels 43 are arranged into roller module 43A.

The roller module 43A facilitates the placing of a container onto the seat section 41, and facilitates the unloading of the container from the seat section 41. At the lower section of the seat section 44, a plurality of moving rollers or wheels 44 are mounted, the moving rollers 44 allow the user to move the seat 4 from one place to another.

The top mounting section 5 is the portion 5 connected to the top end of the vertical shaft 42. The vertical shaft 42 is provided with a pivoting area 421 to connect the top mounting means 5 to the corresponding position of the top section of the seat section 41. The lower section of the top mounting section 5 of the vertical shaft 42 is closely adhered or mounted with the receiving section 51. The corresponding edges of the upper mounting section 5 and the receiving section 51 can be mounted a fastening device 52 connecting the upper mounting means 5 to the receiving section 52. The receiving section 51 is a funnel shaped structure downwardly extended and the center of the funnel structure is a guiding hole 511. The lower section of the receiving section 51 is secured with a support 512 pivotally connected to a covering plate 53. One end of the covering plate 53 closely adhered to the guiding hole 511, and the side facing the support is provided with a heavy block 531. A pull-to-connect element 54 is mounted between the top mounting device 5 and the covering plate 53, and the pull to connect element 54 is a first pull to connect element pivotally connected to the top mounting section 5, and the first pull to connect element 541 pivotally connects to the second pull to connect 542 of the covering plate 53.

The reciprocating element 6 includes a first reciprocating element 61, a second reciprocating element 62 and a third second reciprocating element 63. The first reciprocating element 61 is pivotally mounted at the pressing element 412 at the rear side of the seat section 41, and the first reciprocating element 61 is upwardly pivoted to the inner end of the second reciprocating element 62 in combination with the vertical shaft 42 and the middle section of the second reciprocating element 62 is in combination with the vertical shaft 42. The outer end of the second reciprocating element 62 is connected to the third reciprocating element 63 and the third reciprocating element 63 upwardly mount to the external side of the pivoting area of the top mounting means 5.

Further, the vertical shaft 42 is a fastening device 422 which engages with the third reciprocating element 63 and the second reciprocating element 62.

Figure 8:
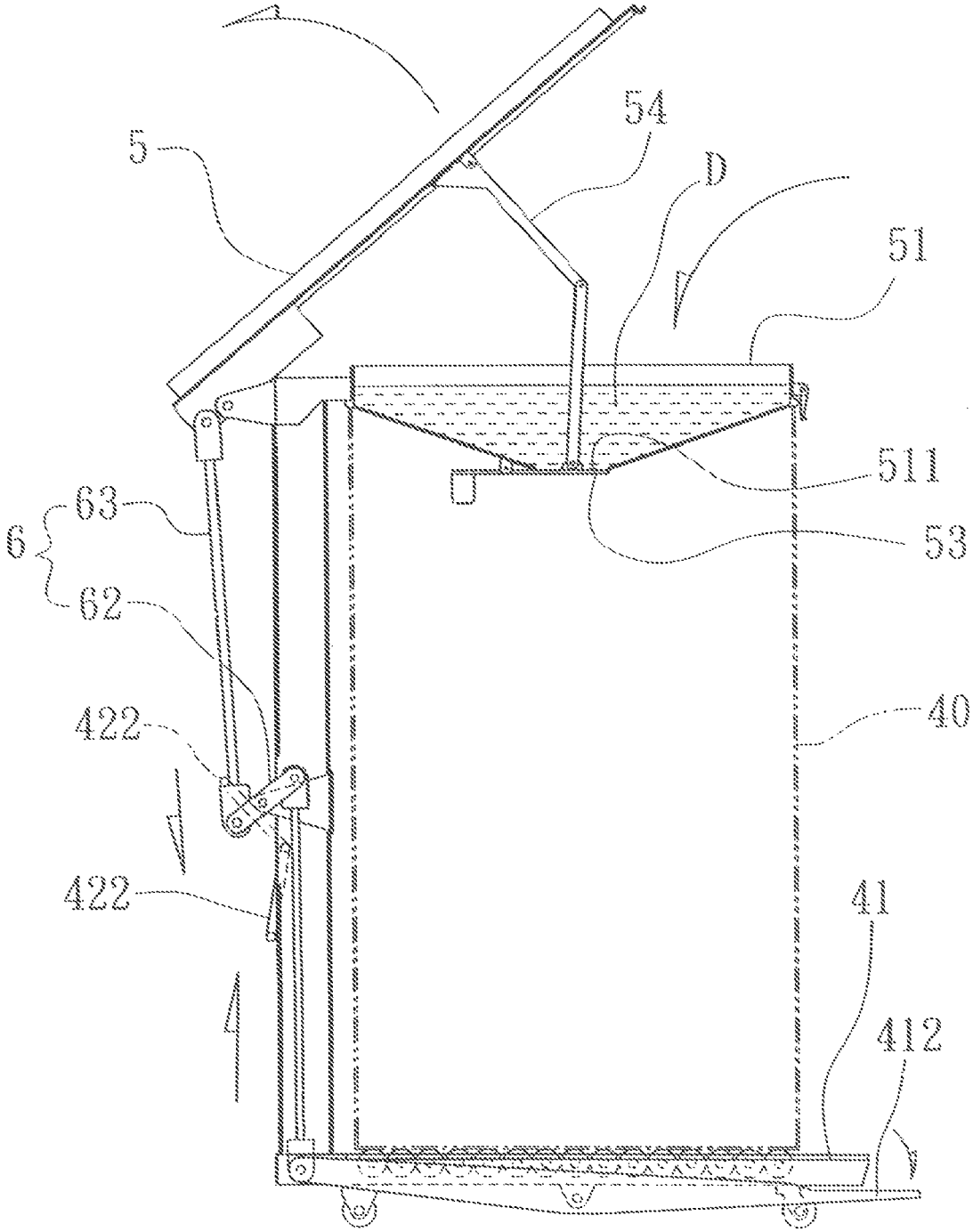
FIG. 8 is a schematic view showing the implementation of the top mounting section of the present invention.

Referring to FIG. 8, there is show the implementation of the holding device of the present invention. The top mounting section 5 is lifted by means of the movement of the pressing element 412 and the reciprocating element 61 and the fastening means 422 is used to engage the third reciprocating element 63 and the second reciprocating element 62, and the top mounting section 5 is positioned at the up-lifted position, and the upper mounting section 5 in the lifting position can extend the pull-and-connect element 54 such that the covering plate 53 seals at the lower section of the guiding hole 511 to facilitate the user to dump liquid waste D into the receiving section 51. On the other hand, when the fastening device 422 between the engagement of the third reciprocating element 63 and the second reciprocating element 62 is removed, the upper mounting section 5 will lower naturally, and closely adhere to the receiving station 51 and the pulling force of the upper mounting section 5 and the pull-and-connect element 54 will follow such movement and eliminated. At this instance, the covering plate 53 is activated, and it will not adhere to the guiding hole 511.

Figure 9:
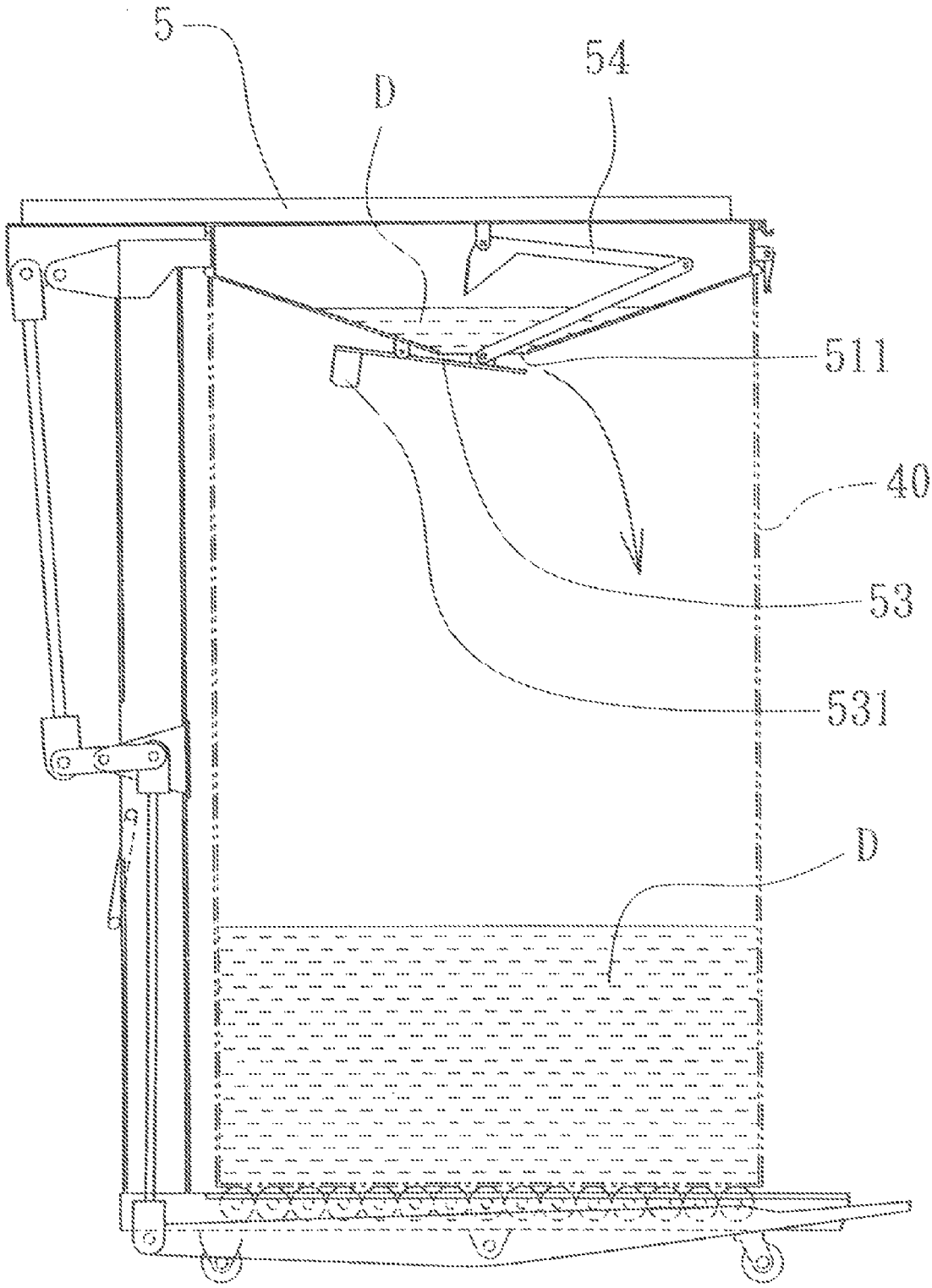
FIG. 9 is a schematic view showing the implementation of the covering plate of the present invention.

Referring to FIG. 9, there is shown a schematic view of the implementation of the covering plate in accordance with the present invention. When the top mounting section 5 moves and closely adheres to the container 40, the force of the pull and connect element 544 to pull the covering plate 53 is diminished, the heavy liquid waste D will cause the covering plate 53 to separate from the guiding hole 511 and the liquid waste will leak into the container 40. When the leading completes, the weight of the heavy block 531 will restore the covering plate 53 to seal the guiding hole 511. Thus, the generation of toxic smell of the liquid waste D from the container 40 is prohibited.

Figure 10:
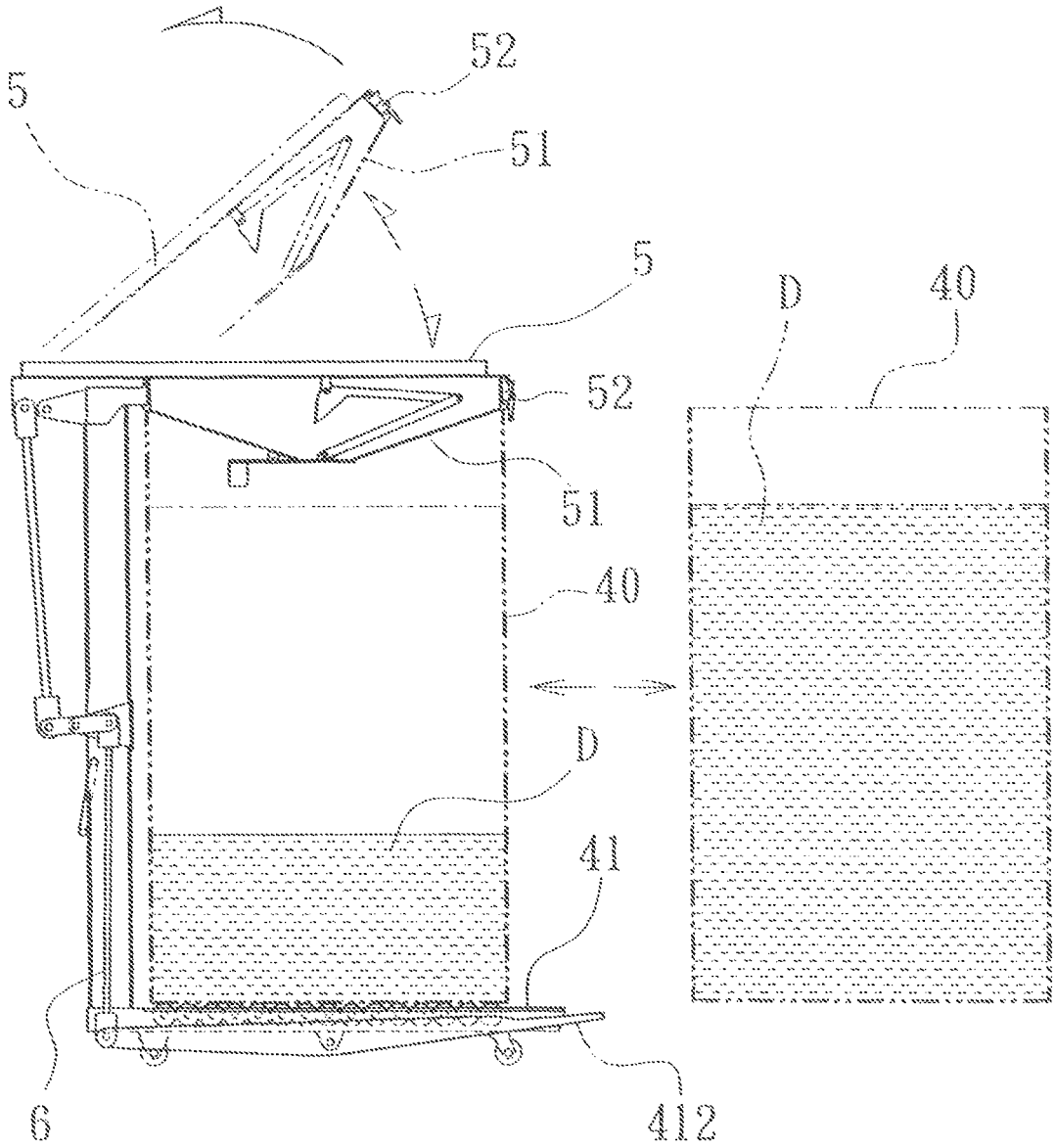
FIG. 10 is a schematic view showing the implementation of the present invention.

Referring to FIG. 10, there is shown the implementation of the holding device for a container of the present invention. When liquid waste D filled in the container at the seat section 41 is to be removed, the fastening device 52 connects the top mounting section 5 and the receiving section 51 to avoid disengagement in the course of upward lifting. After that the pressing element 412 and the reciprocating element 6 will altogether lift up the top mounting section 5 and the receiving section 51 so that the top mounting means 5 and the receiving section 51 are disengaged from the container 40. After the container 40 is removed from the seat section 41.

In accordance with the present invention, the holding device for the engagement with the top mounting means of a container has the advantage of sealing the container 40 contained liquid waste D. The device can effectively prohibit the generated bad odor of the liquid waste to outside environment and prevent the bad odor from dissipation from the container 40. The triggering of the pressing element 412 and the reciprocating element 6 allow the user to manually control the lifting of the top mounting section 5 or the receiving section 51 to disengage with the container 40, facilitating the user in operating of the seat 4, to seal the container 40.

It will be understood that each of the elements described above, or two or more together may also find a useful application in other types of methods differing from the type describe above.

While certain novel features of this invention have been shown and described and are pointed out in the annexed claim it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A holding device for a container for securing comprising a top mounting section of the container including a receiving section, the top mounting section in engagement with the receiving section, wherein the receiving section is pivotally sealed at the lower edge of the top mounting section and a circumferential edge of the top mounting section is a pivot point connecting with the receiving section, the receiving section has a funnel shape extended downward and the extension is a guiding hole, the funnel shaped receiving section is extended till the guiding hole at the center thereof, and the lower section of the receiving section is pivotally provided with a covering plate urging the guiding hole, the receiving section is further mounted with a support for pivotally mounting with the covering plate, and the covering plate urging the other side of the guiding hole facing the support is mounted with a heavy block, and a pull-to-connect element is disposed between the top mounting section and the covering plate, the pull-to-connect element has a first pull-to-connect member pivotally mounted with the top mounting section, the first pull-to-connect member is pivotally mounted to a second pull-to-connect member pivotally connected with the top mounting section, and the covering plate is held in the closed position by the pull-to-connect element while the top mounting section is in the open position.

2. The holding device of claim 1, wherein the top mounting section which corresponds to the circumferential edge of the receiving section is further mounted with a fastening means connecting the top mounting section and the receiving section.

3. The holding device of claim 1, wherein the lower section of the receiving section is a support for pivotally connection with the covering plate, and the covering plate urging the other side of the guiding hole facing the support is mounted with a heavy block.

4. The holding device of claim 1, wherein the circumferential edge of the top mounting section is extending to form a vertical shaft which is mounted with a seat to hold a container, and the seat has a cavity having an operating for holding the present element, one end of the pressing element is extended out of the cavity and the cavity is provided with a cavity connection section for pivotal connection with the pressing element, and the other end of the pressing element is pivotally mounted with a reciprocating member.

5. The holding device of claim 4, wherein the seat is pivotally mounted with a pressing element which is pivotally mounted with a reciprocating element being upwardly connected to the vertical shaft and the pivot point of the top mounting section.

6. The holding device of claim 4, wherein the reciprocating member is provided with a first reciprocating member pivotally connected to the pressing element, and the reciprocating member is pivotally with the inner end of the second reciprocating member connected to the vertical shaft, and the middle section of the second reciprocating member is in engagement with the vertical shaft and the external end of the second reciprocating member is connected to a third reciprocating member at the external edge of the pivotal area of the top mounting section and the vertical shaft.

7. A holding device comprising:

a seat having an external edge mounted with a vertical seat extended upward;

a top mounting section which is pivotally mounted to the top end of a vertical shaft;

a receiving section pivotally sealed at the lower edge of the top mounting section, wherein the circumferential edge of the top mounting section is provided with a pivot point for connection with the receiving section, and the shape of the receiving section is a downward extended funnel shape, and a guiding hole is provided at the extension;

wherein the funnel shaped receiving section is extended till the guiding hole at the corner thereof, and the lower section of the receiving section is pivotally provided with a covering plate urging the guiding hole, the receiving section is further mounted with a support for pivotally mounted with the covering plate, and the covering plate urging the other side of the guiding hole facing the support is mounted with a heavy block, and a pull-to-connect element is disposed between the top mounting section and the covering plate, the pull-to-connect element has a first pull-to-connect member pivotally mounted with the top mounting section, the first pull-to-connect member is pivotally mounted to a second pull-to-connect member pivotally connected with the top mounting section, and the covering plate is held in the closed position by the pull-to-connect element while the top mounting section is in the open position.

8. The holding device of claim 7, wherein the top mounting section which corresponds to the circumferential edge of the receiving section is further mounted with a fastening means connecting the top mounting section and the receiving section.

9. The holding device of claim 7, wherein the lower section of the receiving section is a support for pivotally connection with the covering plate, and the covering plate urging the other side of the guiding hole facing the support is mounted with a heavy block.

10. The holding device of claim 7, wherein the circumferential edge of the top mounting section is extended to form a vertical shaft which is mounted with a seat to hold a container.

11. The holding device of claim 7, wherein the seat is pivotally mounted with a pressing element is pivotally mounted with a reciprocating element being upwardly connected to the vertical shaft and the pivot point of the top mounting section.

12. The holding device of claim 11, wherein the seat has a cavity having an operating towards for holding the pressing element, one end of the pressing element is extended out of the cavity and the cavity is provided with a cavity connection section for pivotal connection with the pressing element, and the other end of the pressing element is pivotally mounted with a reciprocating member.

13. The holding device of claim 11, wherein the reciprocating member is provided with a first reciprocating member pivotally connected to the pressing element, and the reciprocating member is pivotally with the inner end of the second reciprocating member connected to the vertical shaft, and the middle section of the second reciprocating member is in engagement with the vertical shaft and the external end of the second reciprocating member is connected to a third reciprocating member of the external edge of the pivotal area of the top mounting section and the vertical shaft.

14. The holding device of claim 7, wherein the upper end of the seat is provided with a roller module having a plurality of rows of rollers and the two sides of the upper end of the seat are each mounted with a roller module.

15. The holding device of claim 7, wherein the upper end of the seat is distributedly mounted with rolling wheels.

* * * * *